US008646236B2

(12) United States Patent
Hilliard, Sr.

(10) Patent No.: US 8,646,236 B2
(45) Date of Patent: Feb. 11, 2014

(54) INTERLOCKING WEB FOR INSULATED CONCRETE FORMS

(71) Applicant: William R. Hilliard, Sr., Charlotte, NC (US)

(72) Inventor: William R. Hilliard, Sr., Charlotte, NC (US)

( * ) Notice: Subject to any disclaimer, the term of this patent is extended or adjusted under 35 U.S.C. 154(b) by 0 days.

(21) Appl. No.: 13/905,327

(22) Filed: May 30, 2013

(65) Prior Publication Data

US 2013/0326980 A1 Dec. 12, 2013

Related U.S. Application Data

(60) Provisional application No. 61/656,172, filed on Jun. 6, 2012.

(51) Int. Cl.

| | |
|---|---|
| ***E04B 1/16*** | (2006.01) |
| ***E04B 2/86*** | (2006.01) |
| ***E04B 2/58*** | (2006.01) |

(52) U.S. Cl.

CPC ..... *E04B 2/8635* (2013.01); *E04B 2/58* (2013.01)

USPC ..... 52/426; 52/309.11; 52/378

(58) Field of Classification Search

USPC ..... 52/309.1, 309.11, 378, 379, 426, 431, 52/442, 503

See application file for complete search history.

(56) References Cited

U.S. PATENT DOCUMENTS

| | | | | |
|---|---|---|---|---|
| 5,459,971 | A * | 10/1995 | Sparkman | 52/426 |
| 6,438,918 | B2 * | 8/2002 | Moore et al. | 52/426 |
| 2005/0028466 | A1 * | 2/2005 | Titishov | 52/474 |
| 2005/0223669 | A1 * | 10/2005 | Cymbala et al. | 52/426 |
| 2009/0249725 | A1 * | 10/2009 | McDonagh | 52/378 |

* cited by examiner

*Primary Examiner* — William Gilbert

(74) *Attorney, Agent, or Firm* — Shumaker, Loop & Kendrick, LLP

(57) ABSTRACT

An interlocking web for use in insulated concrete form construction configured to engage with a like interlocking web to prevent horizontal and vertical relative movement between webs, the web including a pair of pillars adapted to be embedded within foam insulation panels, each pillar having a male connector at a first end and a female connector at a second end, the male and female connectors having complementary shapes to engage with respective female and male connectors of like vertically-aligned interlocking webs and a pair of bridges interconnecting the pillars.

16 Claims, 5 Drawing Sheets

INTERLOCKING WEB FOR INSULATED CONCRETE FORMS

CROSS-REFERENCE TO RELATED APPLICATION

This application claims priority to U.S. Provisional Application No. 61/656,172 filed Jun. 6, 2012, the entirety of which is incorporated by reference herein.

TECHNICAL FIELD AND BACKGROUND OF THE INVENTION

The present invention relates generally to the field of insulated concrete form (ICF) construction, and more particularly, to a web for use in ICF construction configured to interlock with vertically aligned like webs to prevent vertical and horizontal relative movement between webs to enhance the total retaining strength of an ICF wall prior to filling with concrete.

ICF systems are advantageous for use in constructing walls and foundations due to their high strength, resistance to wind and fire, energy efficiency and durability, among other advantages.

ICF systems generally include foam insulation panels held together in spaced-apart, parallel relation using spacers that attach to the foam insulation panels. A cavity defined between the foam panels is filled with poured concrete that hardens to provide the structural support of the wall. Walls may be created by arranging panels horizontally and stacking panels vertically to form the respective length and height of the wall. Walls may be reinforced by embedding rebar within the poured concrete. The insulated foam panels remain in place after the concrete cures to enhance the strength and insulating value of the wall, among other functions.

Conventional ICF systems utilize separate components for interlocking and spacing the panels, and thus disadvantageously suffer from increased panel complexity, panel/panel separation, and panel/web separation during concrete pouring, among other disadvantages. Conventional ICF systems further do not include interlocking structure that prevents both horizontal and vertical relative movement between panels. Accordingly, provided herein is an interlocking web for use in ICF construction and an ICF system that overcome the disadvantages of the prior art.

BRIEF SUMMARY OF THE INVENTION

In one aspect, an interlocking web for use in ICF systems and an ICF system including an interlocking web are provided herein.

In another aspect, an interlocking web for being embedded within foam insulation panels is provided herein.

In yet another aspect, the interlocking web is configured to engage with vertically aligned like webs in a manner that prevents horizontal and vertical relative movement between engaged webs.

In yet another aspect, the interlocking web enhances the total retaining strength of an ICF wall.

In yet another aspect, the interlocking web is unitary and has a windowed construction for improved embedding within foam insulating panel material.

In yet another aspect, the interlocking web is configured to hold together spaced foam panels and maintain a cavity therebetween for receiving poured concrete.

In yet another aspect, each web includes a pair of spaced pillars interconnected through a pair of spaced bridges, the spaced bridges being generally parallel, the spaced pillars being generally parallel, and the bridges being generally perpendicular to the pillars.

In yet another aspect, the pillars are configured to be substantially embedded within the foam panels and the bridges are configured to be between the foam panels.

In yet another aspect, each pillar includes a male connector at a first end and a female connector at a second end, wherein the male and female connectors are complementary-shaped such that the male connector of a first pillar is configured to engage with the female connector of a vertically aligned second pillar, and the female connector of the first pillar is configured to engage with a male connector of a vertically aligned third pillar.

In yet another aspect, the male and female connectors extend through the vertical edges of the foam panel and are accessible to engage with male and female connectors of vertically aligned like interlocking webs.

In yet another aspect, the bridges include rebar retainers.

In yet another aspect, the rebar retainers project vertically from the bridges to hold the rebar horizontally.

To achieve the foregoing and other aspects and advantages, in one embodiment an interlocking web for use in insulated concrete form construction configured to engage with a like interlocking web to prevent horizontal and vertical relative movement between webs is provided herein. The interlocking web includes a pair of pillars adapted to be embedded within foam insulation panels, each of the pillars having a male connector at a first end and a female connector at a second end, the male and female connectors having complementary shapes such that the male and female connectors are configured to engage with respective female and male connectors of like vertically-aligned interlocking webs. The pair of pillars are interconnected through a pair of spaced bridges.

In a further aspect, the pillars are parallel, the bridges are parallel, and the bridges are perpendicular to the pillars.

In a further aspect, each pillar includes an elongate end plate arranged perpendicular to a common plane of the pillars and bridges.

In a further aspect, each pillar includes a foraminous or windowed spine arranged perpendicular to the elongate end plate.

In a further aspect, the male connector extends beyond a first end of the elongate end plate and the female connector is recessed with respect to a second end of the elongate end plate.

In a further aspect, the male connector is a cylindrical projection and the female connector is a cylindrical recess, wherein the outer diameter of the cylindrical projection is substantially equal to the inner diameter of the cylindrical recess.

In a further aspect, the bridges include rebar retainers.

In another embodiment, provided herein is an insulated concrete form including spaced walls constructed from an expandable insulating material, and an interlocking web interconnecting the spaced walls, the interlocking web including a pair of pillars partially embedded within the spaced walls, each of the pillars having a male connector at a first end and a female connector at a second end, the male and female connectors having complementary shapes such that the male and female connectors are configured to engage with respective female and male connectors of like vertically-aligned interlocking webs, and a pair of bridges interconnecting the pillars.

In a further aspect, each pillar includes an elongate end plate arranged flush with an exterior face of its respective wall.

In a further aspect, the male connectors extend beyond the spaced walls and the female connectors are recessed within the spaced walls.

In a further aspect, each pillar includes a foraminous or windowed spine that is embedded within the spaced walls.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

The subject matter that is regarded as the invention may be best understood by reference to the following description taken in conjunction with the accompanying drawing figures in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
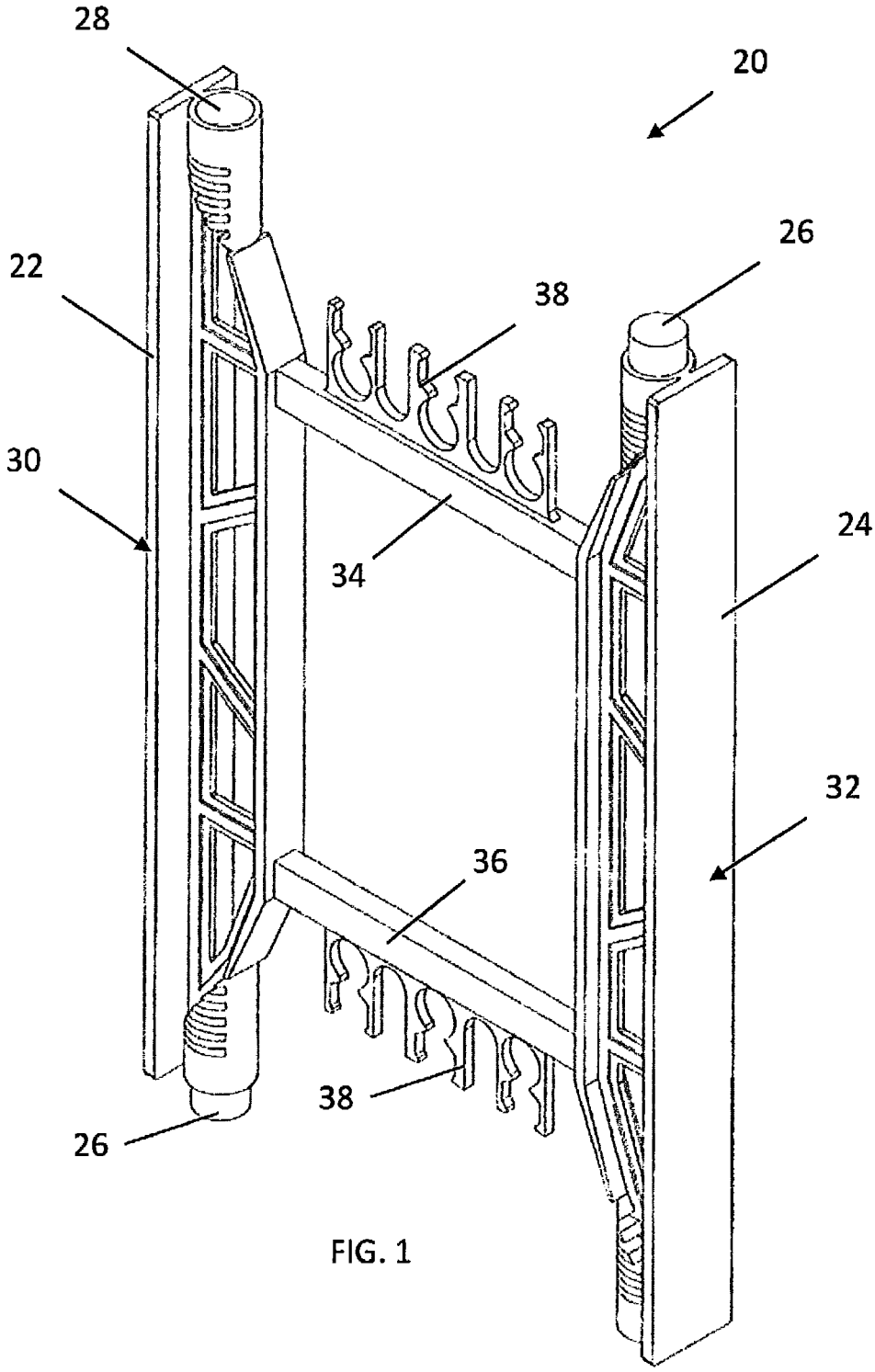
FIG. 1 is a perspective view of an interlocking web according to a preferred embodiment of the invention for use in insulated concrete form construction.
Figure 2:
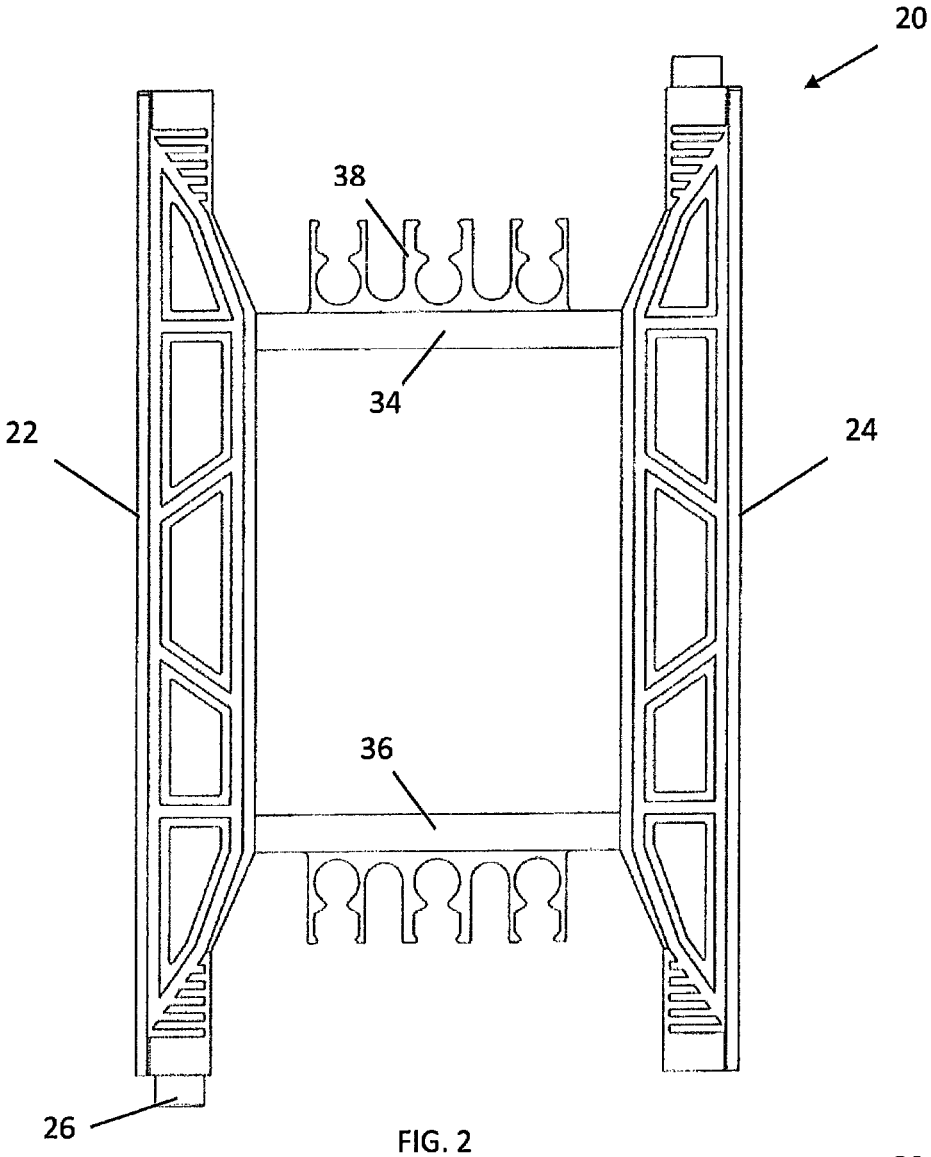
FIG. 2 is a front elevation view of the interlocking web of FIG. 1.
Figure 3:
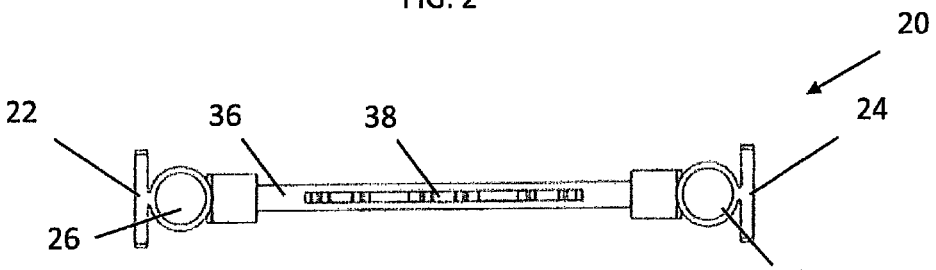
FIG. 3 is a top view of the interlocking web of FIG. 1.

Referring to FIGS. 1-3, one embodiment of an interlocking web for use in insulated concrete form (ICF) construction is shown generally at reference numeral 20. The interlocking web 20, or "web," is a unitary component that may be machined or molded from plastic (e.g., polypropylene), metal, combinations thereof and like materials. The web 20 preferably has a shape and strength sufficient to hold together spaced apart foam panels during and subsequent to the pouring and curing of a concrete core without interfering with the pouring of the concrete or compromising the structural integrity of the cured concrete.

Figure 5:
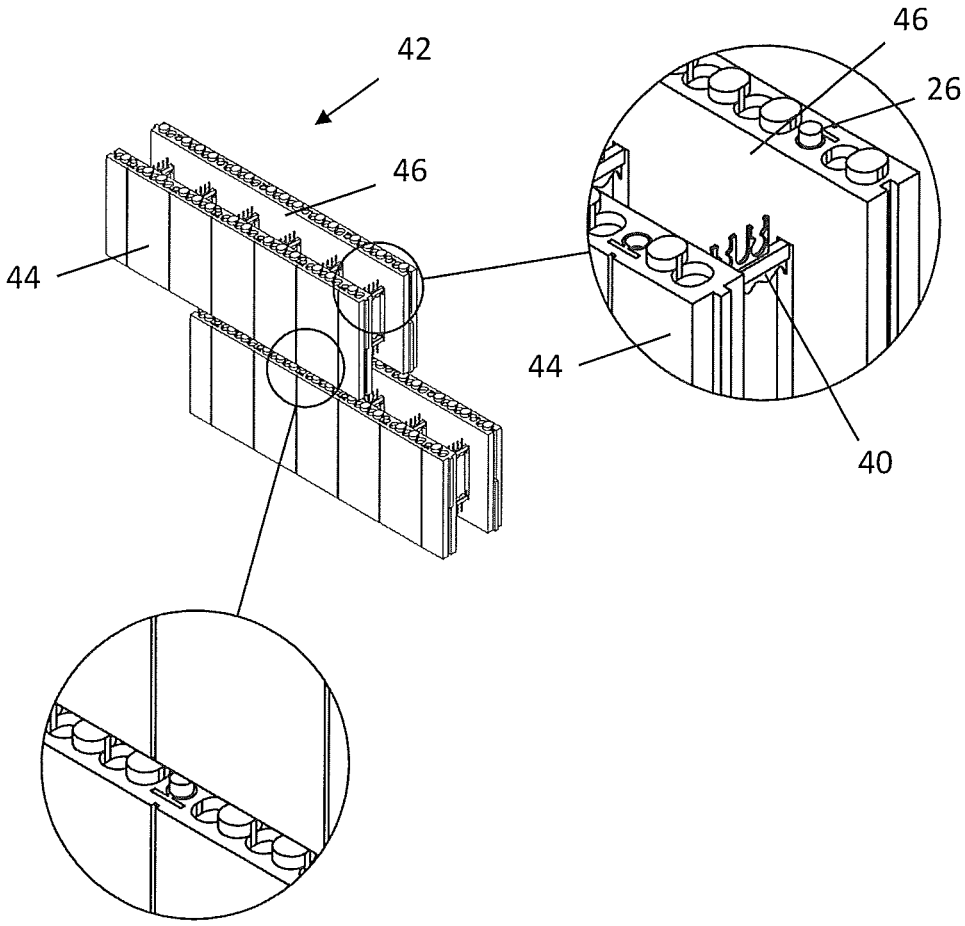
FIG. 5 shows two insulated concrete forms including interlocking webs of FIG. 1 aligned for vertical engagement.
Figure 6:
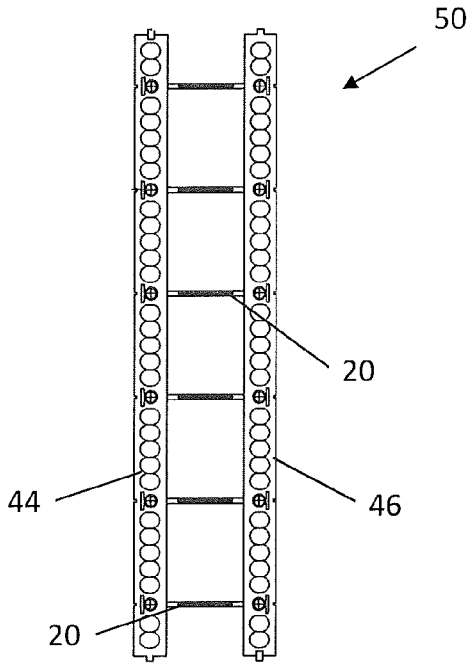
FIG. 6 is an overhead view of an insulated concrete form including a plurality of spaced interlocking webs of FIG. 1.
Figure 7:
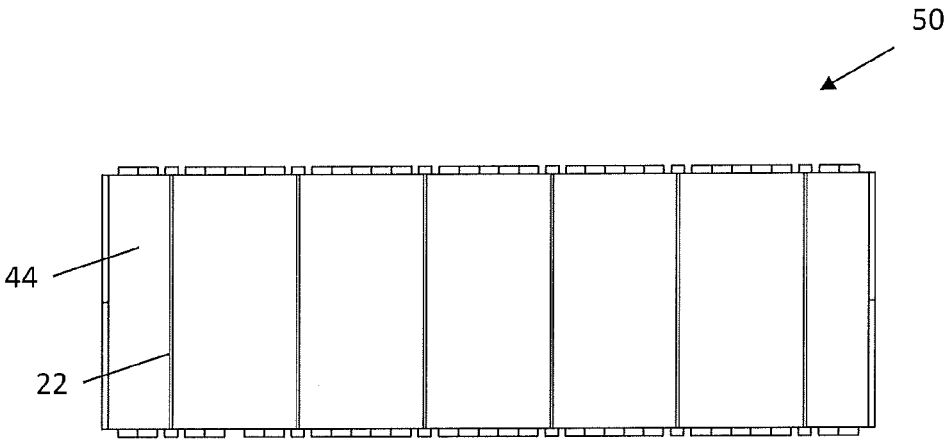
FIG. 7 is a side elevation view of the insulated concrete form of FIG. 6.

The web 20 generally includes spaced pillars 22, 24 configured to be at least partially embedded within foam insulation, for example, expandable polystyrene formed into panels such as panels 44, 46 of FIGS. 5-7. The pillars 22, 24 each terminate at one end in a male connector 26 (e.g., cylindrical stud), and at the other end in a complimentary shaped female connector 28 (e.g., cylindrical recess), such that the male connector 26 is sized to engage in the female connector 28 of a vertically aligned like web to lock the two webs together to prevent horizontal and vertical relative movement between engaged webs. As shown, the pillars 22, 24 are arranged such that the male and female connectors 26, 28 are positioned at opposite ends of the web so that the top and bottom of forms match for ease of installation. It is envisioned that the male and female connectors 26, 28 may have other shapes and/or may be positioned along the same side of the web 20. The male connectors 26 extend through the vertical edge of the foam panels to interlock with the pillars of a like vertically aligned web. The female connectors 28 may be flush with or recessed from the vertical edge of the panels.

The pillars 22, 24 are highly windowed or foraminous such that the expandable foam material is permitted to flow through the windows and bond to itself to firmly embed the web 20 in the foam insulation. The web 20 may be inserted into an expandable polystyrene panel mold, the mold closed, and the expandable polystyrene material injected into panel cavities to flow through and around the web, interlocking the web and panels. Each pillar includes an elongate end plate 30, 32 defining a main planar face that faces outward. The end plates 30, 32 may define the thickness of the panels and may align flush with the outside faces of the panels.

The web 20 further includes a pair of spaced bridges 34, 36 interconnecting the spaced pillars 22, 24. The spaced bridges 34, 36 and the spaced pillars 22, 24 may all be arranged in one plane, that in the form is arranged vertically and perpendicular to the length of the panels. The pillars 22, 24 are parallel, the bridges are parallel 34, 36, and the bridges are perpendicular to the pillars. The spaced pillars 34, 36 include rebar retainers 38 for maintaining a length of rebar substantially horizontal in the form. The rebar retainers 38 of horizontally adjacent webs cooperatively retain lengths of rebar. As shown in FIGS. 1-3, the rebar retainers 38 are positioned facing vertically outward from the center of the web 20, and include various shaped recesses for retaining multiple lengths of rebar of various sizes and shape. Referring to FIG. 5, the spaced bridges 34, 36 may additionally and/or alternatively include rebar seating surfaces 40 facing vertically toward the center of the web 20 that have a sinusoidal profile for seating the rebar in spaced apart relation.

Figure 4:
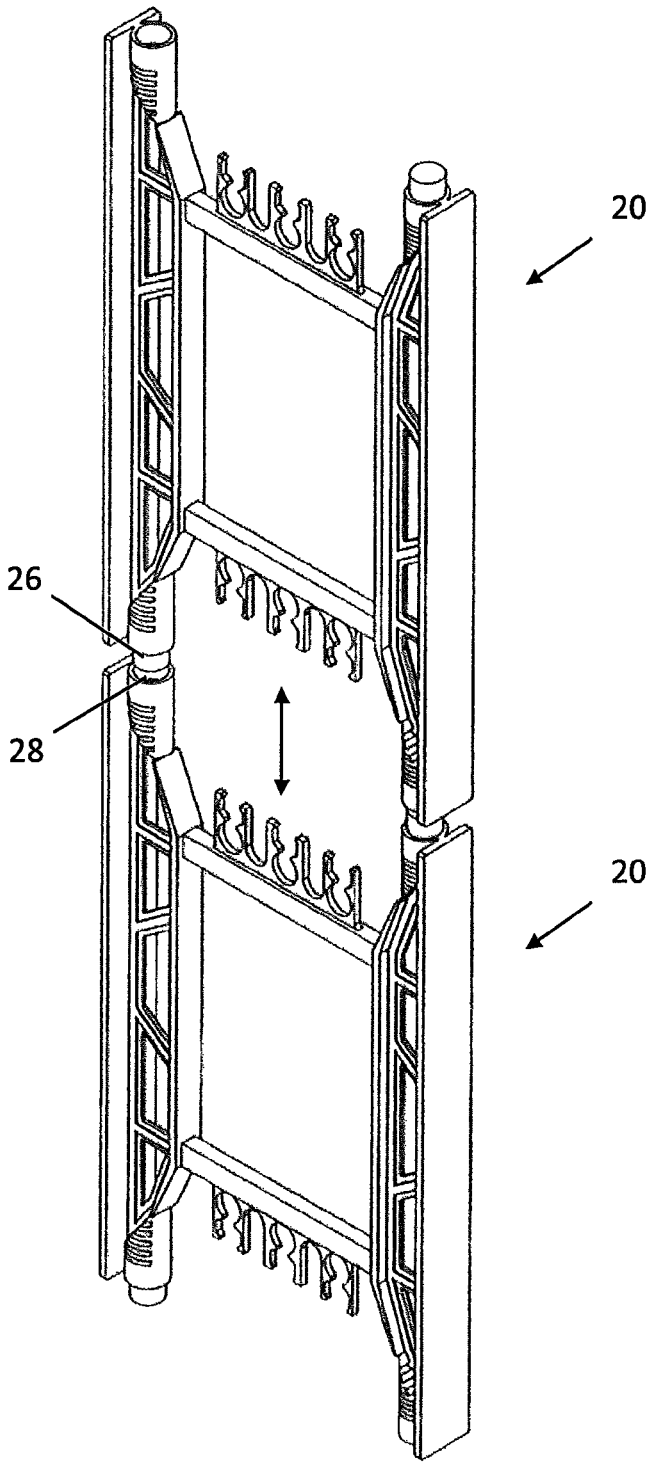
FIG. 4 shows two like interlocking webs aligned for vertical engagement.

Referring to FIG. 4, two identical interlocking webs 20 of adjacent courses of forms are shown vertically aligned and in position to be locked together. The webs 20 lock together by inserting the male connector 26 and female connector 28 along one side of the top web 20 into complimentary shaped male and female connectors of the bottom web 20. Locking the webs together prevents horizontal and vertical movement between the webs and prevents the panels from separating during concrete pouring. The locking of the webs 20 together provides a continuous connection of webs and provides strength to the sidewalls of the forms at their connecting seam, thereby strengthening the seam and preventing blowout of the poured concrete.

Referring to FIGS. 5-7, an insulated concrete form 42 includes spaced foam insulation panels 44, 46 held together by a plurality of horizontally spaced webs 20. FIG. 5 shows two insulated concrete forms including interlocking webs of FIG. 1 arranged vertically staggered in adjacent courses. The seam detail shows the male connector 26 of the web 20 of the top form aligned for engagement with the female connector 28 of the web of the bottom form. The panels may also be formed to define male and female connectors along the vertical edge to interlock with panels in the same row. The detailed view of the top form shows the different rebar retainer configurations, the male and female connectors of an embedded web 20, and the horizontal spacing between the panels 44, 46 achieved by the embedded web 20.

FIG. 6 shows an overhead view of a single insulated concrete form 50 including a plurality of spaced interlocking webs 20. In one example, the webs 20 may be spaced about 20 cm apart, may be spaced from the ends of the panels 44, 46 by about 10 cm, and may define a cavity between the panels about 15 cm wide. A side elevation view of the form 50 is shown in FIG. 7, and shows the sides of the webs positioned flush with the sides of the panels.

The foregoing description provides embodiments of the invention by way of example only. It is envisioned that other embodiments may perform similar functions and/or achieve similar results. Any and all such equivalent embodiments and examples are within the spirit and scope of the present invention and are intended to be covered by the appended claims.

What is claimed is:

1. An interlocking web for use in insulated concrete form construction configured to engage with a like interlocking web to prevent horizontal and vertical relative movement between webs, the interlocking web comprising:

a pair of pillars adapted to be embedded within foam insulation panels, each of the pillars having a male connector at a first end and a female connector at a second end, the male and female connectors having complementary shapes such that the male and female connectors are configured to engage with respective female and male connectors of like vertically-aligned interlocking webs; and a pair of bridges interconnecting the pillars:

wherein the pillars each include an elongate end plate arranged perpendicular to a common plane of the pillars and the bridges, and wherein the male connectors extend beyond a first end of the elongate end plates and the female connectors are recessed with respect to a second end of the elongate end plates.

2. The interlocking web of claim 1, wherein the pillars are parallel, the bridges are parallel, and the bridges are perpendicular to the pillars.

3. The interlocking web of claim 1, wherein each pillar includes a foraminous spine arranged perpendicular to the elongate end plate.

4. The interlocking web of claim 1, wherein the male connector is a cylindrical projection and the female connector is a cylindrical recess, and wherein an outer diameter of the cylindrical projection is equal to an inner diameter of the cylindrical recess.

5. The interlocking web of claim 1, further comprising rebar retainers extending from one or more of the bridges.

6. The interlocking web of claim 1, wherein the male and female connectors are positioned at opposite ends of the pillars.

7. The interlocking web of claim 1, wherein the interlocking web is constructed from polypropylene.

8. An insulated concrete form, comprising:

spaced walls constructed from an expandable insulating material; and an interlocking web interconnecting the spaced walls, the interlocking web including a pair of pillars partially embedded within the spaced walls, each of the pillars having an elongate end plate arranged flush with an exterior face of one of the spaced walls, a male connector at a first end, and a female connector at a second end, the male and female connectors having complementary shapes such that the male and female connectors are configured to engage with respective female and male connectors of like vertically-aligned interlocking webs, and a pair of bridges interconnecting the pillars;

wherein the male connectors extend beyond the spaced walls and the female connectors are recessed within the spaced walls.

9. The insulated concrete form of claim 8, wherein each pillar includes a foraminous spine embedded within the spaced walls.

10. The insulated concrete form of claim 8, wherein the bridges are positioned between the spaced walls.

11. The insulated concrete form of claim 8, wherein one or more of the bridges include rebar retainers.

12. The insulated concrete form of claim 8, wherein the male connector is a cylindrical projection and the female connector is a cylindrical recess, and wherein an outer diameter of the cylindrical projection is equal to an inner diameter of the cylindrical recess.

13. The insulated concrete form of claim 8, further comprising a plurality of spaced interlocking webs interconnecting the spaced walls.

14. The insulated concrete form of claim 8, wherein the spaced walls define interlocking features projecting therefrom for engaging with interlocking features of vertically aligned like spaced walls.

15. The insulated concrete form of claim 8, wherein the walls are foam insulation panels.

16. The insulated concrete form of claim 8, wherein the walls are constructed from expandable polystyrene.

* * * * *